US011186892B2

(12) United States Patent
Lee et al.

(10) Patent No.: US 11,186,892 B2
(45) Date of Patent: Nov. 30, 2021

(54) HOT ROLLED STEEL SHEET HAVING EXCELLENT STRENGTH AND ELONGATION

(71) Applicants: POSCO, Pohang-si (KR); POSTECH ACADEMY-INDUSTRY FOUNDATION, Pohang-si (KR)

(72) Inventors: Sung-Hak Lee, Pohang-si (KR); Kyoo-young Lee, Gwangyang-si (KR); Joo-Hyun Ryu, Gwangyang-si (KR); Sea-Woong Lee, Gwangyang-si (KR); Seok-Su Sohn, Ulsan (KR); Hyung-Soo Lee, Pohang-si (KR); Min-Chul Jo, Pohang-si (KR)

(73) Assignees: POSCO, Pohang-si (KR); POSTECH ACADEMY-INDUSTRY FOUNDATION, Pohang-si (KR)

( * ) Notice: Subject to any disclaimer, the term of this patent is extended or adjusted under 35 U.S.C. 154(b) by 0 days.

(21) Appl. No.: 16/629,757

(22) PCT Filed: Apr. 12, 2018

(86) PCT No.: PCT/KR2018/004271
§ 371 (c)(1),
(2) Date: Jan. 9, 2020

(87) PCT Pub. No.: WO2019/031681
PCT Pub. Date: Feb. 14, 2019

(65) Prior Publication Data

US 2020/0157649 A1 May 21, 2020

(30) Foreign Application Priority Data

Aug. 8, 2017 (KR) ..... 10-2017-0100390

(51) Int. Cl.
*C22C 38/00* (2006.01)
*C22C 38/02* (2006.01)
(Continued)

(52) U.S. Cl.
CPC ..... *C21D 9/46* (2013.01); *C21D 1/18* (2013.01); *C21D 6/005* (2013.01); *C21D 6/008* (2013.01);
(Continued)

(58) Field of Classification Search
CPC ..... C22C 38/002; C22C 38/02; C22C 38/04; C22C 38/06; C22C 38/12;
(Continued)

(56) References Cited

U.S. PATENT DOCUMENTS 4,614,551 A 9/1986 Furukawa et al.
5,454,883 A 10/1995 Yoshie et al.
(Continued)

FOREIGN PATENT DOCUMENTS

CN 1263168 8/2000
CN 101696488 4/2010
(Continued)

OTHER PUBLICATIONS

International Search Report—PCT/KR2018/004271 dated Aug. 2, 2018.
(Continued)

*Primary Examiner* — Michael E. La Villa
(74) *Attorney, Agent, or Firm* — Cantor Colburn LLP

(57) ABSTRACT

Provided is a hot rolled steel sheet having excellent strength and elongation. The hot rolled steel sheet contains, by wt %: carbon (C): 0.05% or more and less than 0.4%, manganese (Mn): 10% to 15%, aluminum (Al): 2% or less, silicon (Si): 0.1 to 2%, molybdenum (Mo): 0.5% or less (excluding 0), vanadium (V): 0.5% or less (excluding 0), phosphorus (P):
(Continued)

0.01% or less, sulfur (S): 0.01% or less, and a remainder of iron (Fe) and inevitable impurities. The hot rolled steel sheet has a microstructure of the hot rolled steel sheet containing, by area %, tempered martensite: 50% to 70%, secondary martensite: 20% or less (excluding 0), epsilon martensite: 2% or less (excluding 0), and retained austenite: 8% to 30%. The hot rolled steel sheet has a tensile strength of at least 1500 MPa, a yield strength of at least 900 MPa and elongation of at least 20%.

4 Claims, 3 Drawing Sheets

(51) Int. Cl.

| | |
|---|---|
| ***C22C 38/04*** | (2006.01) |
| ***C22C 38/06*** | (2006.01) |
| ***C22C 38/12*** | (2006.01) |
| ***C21D 9/46*** | (2006.01) |
| ***C21D 8/02*** | (2006.01) |
| ***C21D 6/00*** | (2006.01) |
| ***C21D 1/18*** | (2006.01) |

(52) U.S. Cl.
CPC ..... *C21D 8/0205* (2013.01); *C21D 8/0226* (2013.01); *C21D 8/0263* (2013.01); *C22C 38/002* (2013.01); *C22C 38/02* (2013.01); *C22C 38/04* (2013.01); *C22C 38/06* (2013.01); *C22C 38/12* (2013.01); *C21D 2211/001* (2013.01); *C21D 2211/008* (2013.01); *Y10T 428/12958* (2015.01); *Y10T 428/12972* (2015.01); *Y10T 428/12979* (2015.01)

(58) Field of Classification Search
CPC ..... Y10T 428/12958; Y10T 428/12972; Y10T 428/12979; C21D 9/46; C21D 1/18; C21D 6/005; C21D 6/008; C21D 8/0205; C21D 8/0226; C21D 8/0263; C21D 2211/001; C21D 2211/008
See application file for complete search history.

(56) References Cited

U.S. PATENT DOCUMENTS

| | | | |
|---|---|---|---|
| 6,425,963 | B1 | 7/2002 | Kaneko et al. |
| 2013/0087253 | A1 | 4/2013 | Matsuda et al. |
| 2014/0308156 | A1 | 10/2014 | Oh et al. |
| 2015/0322551 | A1 | 11/2015 | Lee et al. |
| 2017/0138511 | A1 | 5/2017 | Lee et al. |
| 2019/0093191 | A1 | 3/2019 | Nakagawa et al. |
| 2019/0330721 | A1* | 10/2019 | Hayashi ..... C22C 38/38 |

FOREIGN PATENT DOCUMENTS

| | | |
|---|---|---|
| CN | 106460124 | 2/2017 |
| EP | 2243853 | 10/2010 |
| EP | 2808413 | 12/2014 |
| EP | 3372703 | 9/2018 |
| JP | H04346636 | 12/1992 |
| JP | H05255813 | 10/1993 |
| JP | 2001234282 | 8/2001 |
| JP | 2011184756 | 9/2011 |
| JP | 2015503023 | 1/2015 |
| JP | 2016508184 | 3/2016 |
| KR | 19990042042 | 6/1999 |
| KR | 20090072114 | 7/2009 |
| KR | 20100074988 | 7/2010 |
| KR | 20110046688 | 5/2011 |
| KR | 20120113806 | 10/2012 |
| KR | 20130050138 | 5/2013 |
| KR | 20130069699 | 6/2013 |
| KR | 20140006483 | 1/2014 |
| KR | 20140031752 | 3/2014 |
| KR | 20140083819 | 7/2014 |
| KR | 20150075321 | 7/2015 |
| KR | 20160074768 | 6/2016 |
| KR | 20160078839 | 7/2016 |
| KR | 101677396 | 11/2016 |
| KR | 20170075853 | 7/2017 |
| WO | 2017068756 | 4/2017 |

OTHER PUBLICATIONS

Chinese Office Action—Chinese Application No. 201880050706.5 dated Jan. 28, 2021, citing KR 10-2014-0083819, CN 106460124, CN 101696483, U.S. Pat. No. 4,614,551, CN 1263168, JP 2001-234282, WO 2017/068756, Tang, et al., and Cui.

Cui, Metallography and Heat Treatment, Machinery Industry Press, Oct. 1994, pp. 305-306.

Japanese Office Action—Japanese Application No. 2020-502209 dated Mar. 2, 2021, citing JP 2016-508184, JP 2015-503023, JP H5-255813, and JP H4-346636.

Tang, et al., Theoretical basis and variety development of high-quality hot-rolled strip steel, Metallurgical Industry Press, Oct. 2016, pp. 18-23.

* cited by examiner (a)

(b)

HOT ROLLED STEEL SHEET HAVING EXCELLENT STRENGTH AND ELONGATION

CROSS-REFERENCE TO RELATED APPLICATIONS

This application is a national entry of PCT Application No. PCT/KR2018/004271 filed on Apr. 12, 2018, which claims priority to and the benefit of Korean Application No. 10-2017-0100390 filed Aug. 8, 2017, in the Korean Patent Office, the entire contents of which are incorporated herein by reference.

TECHNICAL FIELD

The present disclosure relates to a hot rolled steel sheet having excellent strength and elongation and a method of manufacturing the same.

BACKGROUND ART

One of the most important factors in the development of energy-saving and environmentally friendly automobiles is the weight reduction of automobiles. To this end, automakers and steelmakers in each country are investing a lot of manpower and research expenses into developing high strength and high formability steel materials. Steel used for structural members such as automobile bodies is mainly applied to parts requiring high energy absorption when a vehicle crash occurs, and requires high elongation as well as high tensile strength. Among the high-strength steel materials applied for the purpose of lightening the body weight, the giga-grade automotive steel sheet market is divided into high-strength cold-rolled sheet and hot press formed steel. In particular, as for the level of 1.5 GPa or above, only HPF materials are currently used. Patent Document 1 refers to said prior art. Patent Document 1 is technology employing a high-strength blank molding method to allow a material to have a sufficient austenite structure at a high temperature of 900° C. or more, followed by molding and quenching the heated material at room temperature, thereby maintaining high strength and enabling process of a complex configuration while finally allowing a product to have the martensite structure. A HPF steel as in Patent Document 1, however, is quenched through contact with a die in which water provides cooling after being formed at a high temperature to secure a final strength. Due to such an additional process, there are some disadvantages such as increased equipment investment, increased costs of the heat treatment and the processing.

Patent document 2 is a technique compensating for the above disadvantages. Patent document 2 attempts to improve strength and ductility by controlling an alloy composition and including martensite, austenite, and ferrite in a microstructure, but involved a problem of an increased cost due to expensive alloy elements, such as chrome (Cr), which are essentially included. In addition, as a cold rolling and a subsequent annealing process are carried out, there are disadvantages in that the time and manufacturing costs increase.

(Patent document 1) Patent document 1: Korean Laid-open Publication Application No. 2014-0006483

(Patent document 2) Patent document 2: Korean Laid-open Publication Application No. 2012-0113806

DISCLOSURE

Technical Problem

An aspect of the present disclosure is to provide a hot rolled steel sheet having excellent strength and elongation using manganese segregation, and a method for manufacturing the same.

Technical Solution

An aspect of the present disclosure provides a hot rolled steel sheet having excellent strength and elongation, containing, by wt %: carbon (C): 0.05% or more and less than 0.4%, manganese (Mn): 10% to 15%, aluminum (Al): 2% or less, silicon (Si): 0.1 to 2%, molybdenum (Mo): 0.5% or less (excluding 0), vanadium (V): 0.5% or less (excluding 0), phosphorus (P): 0.01% or less, sulfur (S): 0.01% or less, and a remainder of iron (Fe) and inevitable impurities, wherein the hot rolled steel sheet has a microstructure containing, by area %, tempered martensite: 50% to 70%, secondary martensite: 20% or less (excluding 0), epsilon martensite: 2% or less (excluding 0), and a remainder of austenite: 8% to 30%.

Another aspect of the present disclosure is to provide a method for manufacturing a hot rolled steel sheet having excellent strength and elongation, including: reheating a slab comprising, by wt %: carbon (C): 0.05% or more and less than 0.4%, manganese (Mn): 10% to 15%, aluminum (Al): 2% or less, silicon (Si): 0.1 to 2%, molybdenum (Mo): 0.5% or less (excluding 0), vanadium (V): 0.5% or less (excluding 0), phosphorus (P): 0.01% or less, sulfur (S): 0.01% or less, and a remainder of iron (Fe) and inevitable impurities at a temperature of 1150° C. to 1250° C.; finish hot-rolling the reheated slab at a temperature of 900° C. to 1100° C. to obtain a hot rolled steel sheet; coiling the hot rolled steel sheet at a temperature range of 500° C. to 700° C.; air-cooling the coiled hot rolled steel sheet to room temperature; tempering the air-cooled hot rolled steel sheet at a temperature of 200° C. to 500° C.; and air-cooling the tempered hot rolled steel sheet.

Advantageous Effects

According to the present disclosure, a hot rolled steel sheet having a tensile strength of 1500 MPa grade and elongation of at least 20%, and a method for manufacturing the same are provided.

BRIEF DESCRIPTIONS OF DRAWINGS

BEST MODE

Figure 1:
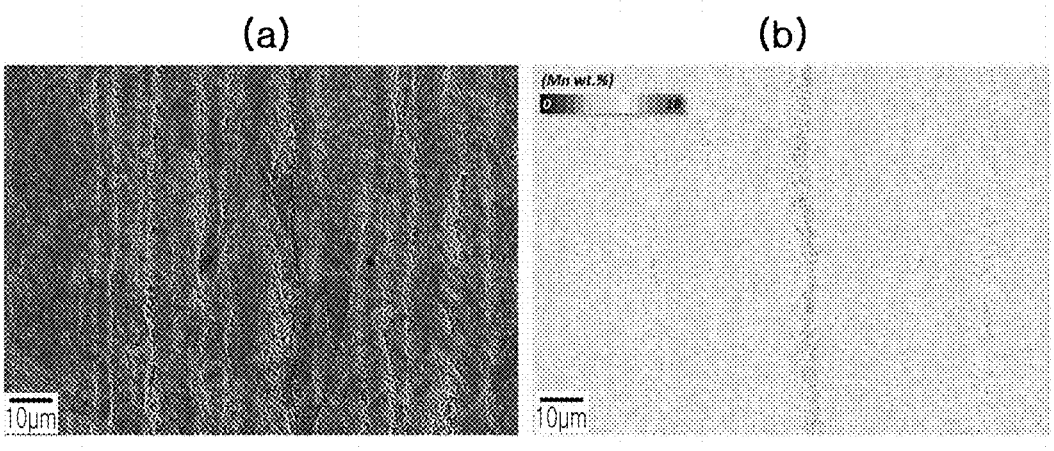
FIG. 1 is a photographic image of an Mn segregated region after hot rolling of a steel observed by electron probe micro-analysis (EPMA), where (a) is an SEM image thereof and (b) is a mapping image of the Mn composition of (a).

FIG. 1 is a photographic image of an Mn segregated region after hot rolling of a steel observed by electron probe micro-analysis (EPMA), where (a) is an SEM image thereof and (b) is a mapping image of the Mn composition of (a). When an austenite structure having various transformation mechanisms is to be included in addition to the martensite structure in the steel sheet to secure high strength and excellent elongation, an addition of large amounts of Mn and C as austenite stabilizing element would generate a band type segregation along a rolling direction during the rolling process due to the large amount of Mn, thereby generating Mn-rich layer and Mn-deficient layer. The segregation is conventionally known to bring about anisotropy of mechanical properties and reduction in ductility and formability. The present inventors, however, recognized that excellent strength, elongation and work hardening by utilizing the Mn segregated regions to produce an austenite band structure having appropriate stability and appropriately producing martensite and austenite, thereby suggesting the present disclosure.

Hereinafter, the present disclosure will be described in detail. An alloy composition will first be described. "%" indicated Herein below refers to "weight %."

C: 0.05% or more and less than 0.4%

Carbon (C) is an essential element for high strength and contributes to solid solution strengthening and precipitation strengthening. Further, at least 0.05% of C is required as an element for stabilizing austenite, and when an amount of C is less than 0.05%, it difficult to produce retained austenite. The C shows a relatively fast diffusion rate during tempering, and contributes to growth of the retained austenite and new austenite nucleation. The higher the C, the higher the phase fraction of the retained austenite after heat treatment. When an amount of C is 0.4% or more, stability of the retained austenite may excessively increase, thereby making it difficult to have transformation induced plasticity upon deformation. This would rather reduce work hardening and consequently, tensile strength. Meanwhile, it is preferable that the amount of C be in the range of 0.05% to 0.3%, more preferably 0.1% to 0.25%.

M: 10% to 15%

Together with C, manganese (Mn) is an element stabilizing the austenite phase. As Mn has a high affinity with C, an addition of Mn increases the amount of C, which can be employed in the steel, and this may further contribute to the stabilization of the austenite. In particular, when Mn is added in an amount range suggested in the present disclosure, a Mn segregated region is produced during the hot rolling process. A fraction, a shape and a size of the retained austenite phase can be controlled by such production of the Mn segregated region together with tempering at 200° C. to 500° C. to produce austenite having appropriate stability, thereby obtaining sufficient work hardening effect due to the transformation induced plasticity upon deformation. When an amount of Mn is less than 10%, however, the austenite cannot be sufficiently stabilized during tempering, thereby making it difficult to have the strengthening effect due to the transformation induced plasticity. An amount of Mn exceeding 15% lowers fractions of tempered martensite and secondary martensite in a final micro structure after tempering, resulting in lowered strength. Meanwhile, it is advantageous that the amount of Mn is in the range of 10.1% to 14%, more preferably 10.2% to 12.5%.

Al: 2% or less

Aluminum (Al) is a ferrite stabilizing element increasing yield strength by securing certain amounts of tempered and secondary martensite after tempering. Further, Al is advantageous in reducing material variation due to manufacturing process variation as Al increases ranges of an austenite region and a two phase region to embody an intended phase fraction in a wide range of temperature. When an amount of Al exceeds 2.0%, castability deteriorates, and surface quality is degraded due to intensification of the steel surface oxidation during hot rolling. Further, deformation behaviors of the retained austenite changes, making it difficult to bring about the transformation induced plasticity effect and causing reduced work hardening. Accordingly, the amount of Al is limited to 2.0% or less in the present disclosure. Meanwhile, it is advantageous that the amount of Al is in the range of 0.5% to 2%, more preferably 0.5% to 1.5%.

Si: 0.1% to 2%

Silicon (Si) is an element delaying growth of carbide during heating of the tempering process to disperse the solute carbon in the austenite phase and thus effective in stabilizing an austenite phase. Further, Si is soluble in the tempered martensite, the secondary martensite and the austenite, thereby improving yield strength and tensile strength of the steel due to solid solution strengthening. To obtain such effects, it is preferable that Si be included in an amount of 0.1% or more. When the amount of Si exceeds 2.0%, however, a large amount of Si oxides are formed on a surface during the hot rolling, thereby deteriorating the surface quality.

Mo: 0.5% or less (excluding 0)

Molybdenum (Mo) has effects of alleviating brittleness of grain boundary fracture by impurity elements such as phosphate (P), sulfur (S), and the like, and improving the tensile strength by controlling the fraction and stability of the retained austenite. Further, Mo shows a precipitation strengthening effect by grain refinement and nano grains and thus improves the yield strength and the tensile strength. When an amount of Mo exceeds 0.5%, however, toughness of the steel is lowered and become disadvantageous in terms of costs.

V: 0.5% or less (excluding 0)

Vanadium (V) plays an important role in increasing the yield strength and the tensile strength of the steel by forming fine precipitates at a low temperature and a grain refinement effect. When an amount of V exceeds 5%, however, coarse carbides are formed at a high temperature, thereby giving rise to deterioration of hot workability.

P: 0.01% or less

P (phosphorus) is an inevitable impurity and is an element, which is a main cause of deterioration of the workability of steel due to segregation. As such, it is preferable that an amount thereof be controlled to be as low as possible. Theoretically, it is advantageous that an amount of P is controlled to 0%; however, P is unavoidably contained in terms of the manufacturing process. Accordingly, it is important to control an upper limit thereof; in the present disclosure, the upper limit of P is limited to 0.01%.

S: 0.01% or less

Sulfur (S) is an inevitably contained impurity and forms coarse manganese sulfide (MnS), which causes defects such as flange cracks, and greatly deteriorates hole expandability of a steel sheet. Accordingly, it is preferable that an amount thereof be controlled to be as low as possible. Theoretically, it is advantageous that an amount of S is controlled to 0%; however, S is unavoidably contained in terms of the manufacturing process. Accordingly, it is important to control an upper limit thereof; in the present disclosure, the upper limit of S is limited to 0.01%.

The hot rolled steel sheet of the present disclosure contains a remainder of Fe and other unavoidable impurities in addition to the alloy composition.

Meanwhile, it is preferable that a microstructure of the present disclosure contain, by area %, tempered martensite: 50% to 75%, secondary martensite: 20% or less (excluding 0), epsilon martensite: 2% or less (excluding 0), and retained austenite: 8% to 30%.

Tempered martensite: 50 area % to 70 area %

Tempered martensite is softened martensite after martensite formed in the hot rolling process is tempered and partially contributes to plastic deformation due to generation and movement of dislocations. In terms of mechanical properties, the tempered martensite contributes to securing yield strength and tensile strength depending on the fraction thereof. When the fraction of the tempered martensite is less than 50%, there is a disadvantage that the yield strength and the tensile strength are reduced, whereas the fraction exceeding 75% makes it difficult to secure sufficient elongation.

Secondary martensite: 20 area % (excluding 0)

Secondary martensite contributes to yield strength. When a fraction of the secondary martensite exceeds 20%, the elongation is drastically lowered. Meanwhile, the secondary martensite in the present disclosure refers to martensite newly generated after tempering heat treatment and quenching. When tempering, an austenite band structure grows along the manganese segregated region, and stability of the coarsely grown austenite is lowered, thereby causing shear transformation into martensite when quenching. Accordingly, the secondary martensite shows higher dislocation density than temper martensite, and this greatly contributes to an increase in the yield strength and has a negative effect on the elongation.

Epsilon martensite: 2 area % or less (excluding 0)

Epsilon martensite is martensite produced in some austenite grains after tempering heat treatment and quenching. The epsilon martensite contributes to increasing a work hardening rate by causing the formation of the transformation induced martensite in two steps, thereby improving the tensile strength and elongation value as a whole. If a fraction of the epsilon martensite exceeds 2%; however, a nucleation site of a transformation induced martensite formed during the tensile deformation is provided in advance. This leads to rapid progress of the transformation induced plasticity, thereby reducing the tensile strength improving effect.

Retained austenite: 8 area % to 30 area %

The retained austenite is advantageous into secure a work hardening effect by the transformation induced plasticity effect through securing appropriate stability, and contributes to secure tensile strength and a deformation rate simultaneously. When a fraction of the retained austenite is less than 8%, it is difficult to secure a sufficient transformation induced plasticity effect, whereas when the fraction exceeds 30%, the fraction of martensite is reduced, causing a decrease in the yield strength.

Meanwhile, it is preferable that an average thickness of the Mn segregated region be 1.9 μm to 9.1 μm. When the average thickness is less than 1.9 μm, stability of the retained austenite produced after the tempering heat treatment excessively increases, thereby making it difficult to have transformation induced plasticity upon deformation. The average thickness exceeding 9.1 μm increases grains due to the growth of austenite during the tempering heat treatment, which would transform into the secondary martensite through cooling transformation during quenching. Accordingly, it is difficult to expect the transformation induced plasticity effect caused by the band-shaped austenite.

Further, it is preferable that an average distance between the manganese segregated regions is 2.2 μm to 30 μm. When the average distance is less than 2.2 μm, the advantages of the band type austenite may be lost. The band type austenite has a structure surrounded by harder-phase martensite and is subject to hydrostatic pressure due to the martensite. When the austenite is transformed into martensite, approximately 0.9% of volume expansion occurs. In this case, surrounding martensite suppresses expansion of the volume and stabilization, thereby exhibiting continuous transformation effect until fracture and ultimately contributing to improvement of ensile properties. Geometrically necessary dislocation is formed at an interface due to volumetric expansion occurring during the transformation of the austenite into martensite, which leads to an effective work hardening effect with a deformation rate gradient in the band structure. The average distance exceeding 30 μm, however, is disadvantageous in that a sufficient work hardening effect due to production of geometrically required dislocations is not easily satisfied.

The hot rolled steel sheet of the present disclosure, suggested as the above, is expected to be able to replace an ultra-high strength cold rolled steel and a HPF steel by simultaneously having tensile strength of at least 1500 MPa, yield strength of at least 900 MPa and elongation of at least 20%. Due to reduced thickness of the steel sheet by increased strength, the hot rolled steel sheet can contribute to weight reduction of a body and fuel efficiency.

Hereinafter, a method for manufacturing the hot rolled steel sheet will be described.

It is preferable that a steel slab having the previously described alloy composition be reheated at a temperature of 1150° C. to 1250° C. The reheating temperature range is an austenite single phase region and can promote homogenization of a material through the slab reheating treatment. When the steel slab reheating temperature is less than 1150° C., a load drastically increases during the hot rolling, which is to be described below, whereas the temperature exceeding 1250° C. increases an amount of surface scale and an amount of material loss. In addition, it is preferable to limit to the above temperature range as a liquid phase may exist when Mn is contained in a large amount. Meanwhile, it is advantageous that the slab reheating temperature is in the range of 1150° C. to 1200° C., more preferably in the range of 1180° C. to 1200° C.

It is preferable that a time for reheating the slab be at least one hour. When the reheating time is less than an hour, it is disadvantageous that the homogenization effect is insufficient.

It is preferable that the reheated slab is finish hot-rolled at a temperature of 900° C. to 1100° C. to obtain a hot rolled steel sheet. Through the hot rolling, a hot rolled steel sheet having a thickness of about 2.8 mm can be produced from a slab having a thickness of about 40 mm to 45 mm. In the finish hot-rolling temperature range, the austenite single phase is formed, although VC carbides begin to partially form from 900° C. Accordingly, when the finish hot-rolling temperature is less than 900° C., coarse carbides are formed, thereby cause a problem of reduced hot workability, whereas when exceeding 1100° C., there is a problem that there is more likelihood that surface defects are generated due to scale.

It is preferable that thus-obtained hot-rolled steel sheet be coiled at a temperature of 500° C. to 700° C. When the coiling temperature exceeds 700° C., oxide films are excessively formed on a surface of the steel sheet, thereby causing defects. When the temperature is less than 500° C., which is a temperature range in which $Mo_2C$ carbides are formed, coarse carbides may be formed, leading to deterioration of physical properties. Meanwhile, it is advantageous that a coiling temperature is more preferably in the range of 550° C. to 700° C., still more preferably in the range of 600° C. to 700° C.

It is preferable that the coiled hot rolled steel sheet be air-cooled.

It is preferable that the air-cooled hot rolled steel sheet be tempered at 200° C. to 500° C. The hot rolled steel sheet of the present disclosure shows a structure containing martensite and part of the retained austenite through hot rolling process. In contrast, a structure of the martensite produced through cooling transformation is significantly strong but excessively brittle. Further, the retained austenite produced during cooling lacks sufficient stability and does not show deformation behaviors such as transformation induced plasticity, and does thus not have a significant effect on work hardening. Accordingly, the brittle martensite is recovered by tempering heat treatment at said temperature range to form tempered martensite, which may have somewhat lowered strength but be provided with a certain degree of ductility. Mn and C, austenite stabilizing elements, have increased stability through diffusion into the retained austenite so that transformation induced plasticity occurs during deformation. To sufficiently obtain the effect, it is preferable that the tempering temperature be 200° C. When the temperature exceeds 500° C., however, an amount of the retained austenite is rather reduced and an amount of secondary martensite produced during cooling increases, resulting in reduced ductility. Meanwhile, the tempering temperature is more preferably in the range of 300° C. to 500° C., and still more preferably in the range of 400° C. to 500° C.

It is preferable that the tempering be carried out for 0.5 hours to 10 hours. When the tempering is carried out for less than 0.5 hours, sufficient fractions of tempered martensite and retained austenite cannot easily be obtained. Meanwhile, the fraction of the retained austenite tends to increase as the tempering time and temperature increase. When the tempering time exceeds 10 hours, the amount of the retained austenite is rather reduced, and the amount of the secondary martensite produced during cooling increases, thereby decreasing ductility.

It is preferable that the tempered hot-rolled steel sheet be air-cooled. Through the air-cooling process, the tempered martensite and the retained austenite which containing the austenite stabilizing element produced by the tempering process can be maintained at room temperature.

Hereinafter, the present invention will be described in more detail with reference to the Examples. However, the following Examples are merely for describing the present disclosure and do not limit the present disclosure.

EXAMPLE

A steel slab having the composition as shown in Table 1 below is prepared, and a hot-rolled steel sheet is manufactured under the condition described in Table 2 below followed by air-cooling. Thus-obtained hot-rolled steel sheet was then measured in terms of the microstructure and the mechanical properties, and the results are shown in Table 3 below.

TABLE 1

| | Alloy composition (weight %) | | | | | | | |
|---|---|---|---|---|---|---|---|---|
| Steel type | C | Mn | Al | Si | Mo | V | P | S |
| Inventive Steel 1 | 0.107 | 10.46 | 0.042 | 0.963 | 0.313 | 0.497 | 0.001 | 0.01 |
| Inventive Steel 2 | 0.098 | 12.12 | 0.023 | 1.023 | 0.301 | 0.499 | 0.001 | 0.01 |
| Comparative Steel 1 | 0.102 | 5.21 | 0.101 | 1.021 | 0.323 | 0.532 | 0.001 | 0.01 |
| Comparative Steel 2 | 0.117 | 16.13 | 0.121 | 0.998 | 0.331 | 0.521 | 0.001 | 0.01 |
| Comparative Steel 3 | 0.101 | 10.87 | 2.198 | 0.978 | 0.503 | 0.489 | 0.001 | 0.01 |
| Comparative Steel 4 | 0.113 | 16.21 | 2.201 | 0.021 | 0.523 | 0.532 | 0.001 | 0.01 |

TABLE 2

| Steel type | Steel No. | Slab reheating temp (° C.) | Finish hot-rolling temp (° C.) | Coiling temp (° C.) | Tempering temp (° C.) | Tempering time (hr) |
|---|---|---|---|---|---|---|
| Inventive Steel 1 | Inventive Example 1 | 1200 | 900 | 650 | 200 | 1 |
| Inventive Steel 2 | Inventive Example 1 | 1200 | 900 | 650 | 300 | 1 |
| Inventive Steel 3 | Inventive Example 1 | 1200 | 900 | 650 | 400 | 1 |
| Inventive Steel 4 | Inventive Example 1 | 1200 | 900 | 650 | 400 | 10 |
| Inventive Steel 5 | Inventive Example 1 | 1200 | 900 | 650 | 500 | 1 |
| Inventive Steel 6 | Inventive Example 2 | 1200 | 900 | 650 | 400 | 1 |
| Comparative Steel 1 | Inventive Example 2 | 1200 | 900 | 650 | 600 | 1 |
| Comparative Steel 2 | Inventive Example 2 | 1200 | 900 | 650 | 800 | 1 |
| Comparative Steel 3 | Inventive Example 1 | 1200 | 900 | 650 | 600 | 1 |
| Comparative Steel 4 | Inventive Example 1 | 1200 | 900 | 650 | 700 | 1 |
| Comparative Steel 5 | Inventive Example 1 | 1200 | 900 | 650 | 800 | 1 |
| Comparative Steel 6 | Inventive Example 1 | 1200 | 900 | 650 | 900 | 1 |

TABLE 2-continued

| Steel type | Steel No. | Slab reheating temp (° C.) | Finish hot-rolling temp (° C.) | Coiling temp (° C.) | Tempering temp (° C.) | Tempering time (hr) |
|---|---|---|---|---|---|---|
| Comparative Steel 7 | Comparative Example 1 | 1200 | 900 | 650 | 400 | 1 |
| Comparative Steel 8 | Comparative Example 2 | 1200 | 900 | 650 | 400 | 1 |
| Comparative Steel 9 | Comparative Example 3 | 1200 | 900 | 650 | 400 | 1 |
| Comparative Steel 10 | Comparative Example 4 | 1200 | 900 | 650 | 400 | 1 |

TABLE 3

| Steel type | Tempered martensite (area %) | Secondary martensite (area %) | Epsilon martensite (area %) | Retained austenite (area %) | Tensile strength (MPa) | Yield strength (MPa) | Elong-ation (%) |
|---|---|---|---|---|---|---|---|
| Inventive Steel 1 | 74.5 | 9.7 | 1.8 | 14.0 | 1618 | 901 | 21.9 |
| Inventive Steel 2 | 74.9 | 10.4 | 1.7 | 13.0 | 1753 | 900 | 20.0 |
| Inventive Steel 3 | 71.8 | 7.1 | 1.0 | 20.1 | 1596 | 1012 | 20.7 |
| Inventive Steel 4 | 64.8 | 10.1 | 1.1 | 24.0 | 1560 | 1018 | 20.1 |
| Inventive Steel 5 | 54.3 | 18.0 | 1.3 | 26.4 | 1567 | 908 | 20.0 |
| Inventive Steel 6 | 50.0 | 18.1 | 1.9 | 30.0 | 1539 | 911 | 27.0 |
| Comparative Steel 1 | 42.9 | 18.5 | 1.5 | 37.1 | 1517 | 883 | 24.7 |
| Comparative Steel 2 | 34.2 | 19.3 | 1.3 | 45.2 | 1463 | 891 | 18.9 |
| Comparative Steel 3 | 47.9 | 18.4 | 1.3 | 32.4 | 1416 | 616 | 16.4 |
| Comparative Steel 4 | 46.1 | 21.0 | 0.9 | 32.0 | 1423 | 894 | 12.0 |
| Comparative Steel 5 | 42.6 | 21.5 | 0.8 | 35.1 | 1516 | 802 | 10.9 |
| Comparative Steel 6 | 38.6 | 21.3 | 0.9 | 39.2 | 1660 | 758 | 9.1 |
| Comparative Steel 7 | 89.2 | 5.5 | 0.1 | 5.2 | 1758 | 684 | 5.3 |
| Comparative Steel 8 | 16.3 | 24.1 | 3.5 | 56.1 | 1254 | 654 | 31.1 |
| Comparative Steel 9 | 73.9 | 9.2 | 1.3 | 15.6 | 1485 | 1098 | 16.9 |
| Comparative Steel 10 | 44.9 | 16.8 | 3.1 | 35.2 | 1423 | 821 | 19.5 |

It can be seen that Inventive Examples 1 to 6 manufactured to satisfy the alloy composition and the manufacturing conditions suggested in the present disclosure have a tensile strength of at least 1500 MPa, a yield strength of at least 900 MPa and elongation of at least 20%, targeted in the present disclosure through securing fraction microstructure of appropriate level.

Comparative Examples 1 to 6, however, satisfy the alloy composition suggested in the present disclosure, but not the tempering temperature, and thus not able to secure an appropriate level of the microstructure fraction suggested in the present disclosure. Accordingly, Comparative Examples 1 to 6 do not have excellent mechanical properties.

It can also be seen that Comparative Examples 7 to 10 satisfy the manufacturing conditions of the present disclosure, but not the alloy composition, thereby being unable to simultaneously secure high levels of tensile strength, yield strength and elongation.

Figure 2:
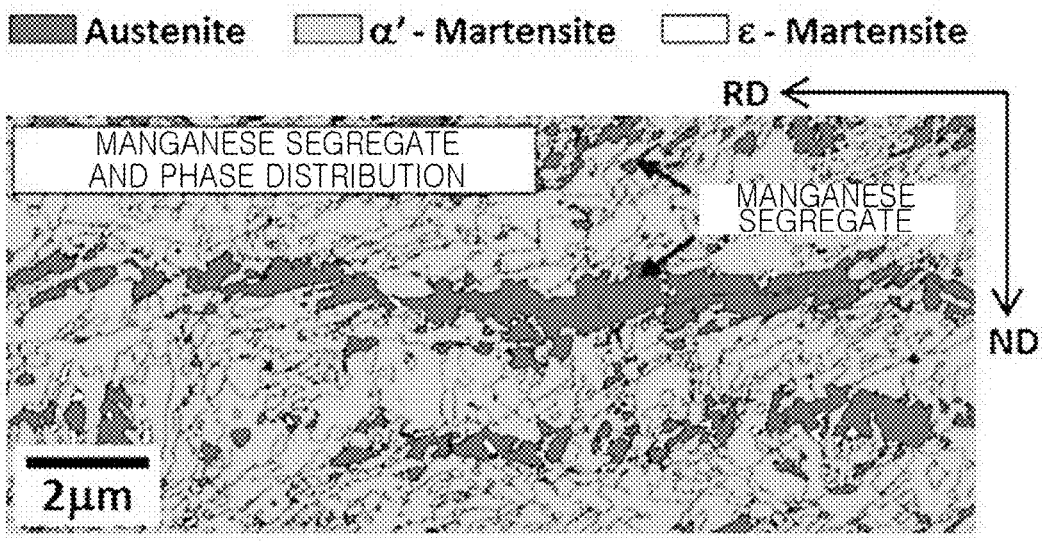
FIG. 2 is a photographic image of Inventive Example 3 observed by electron back-scatter diffraction (EBSD), where (a) is a phase map of austenite (FCC), martensite (BCC) and epsilon martensite (HCP), and (b) is an inverse pole figure map on the austenite (FCC) phase of (a).
Figure 2:
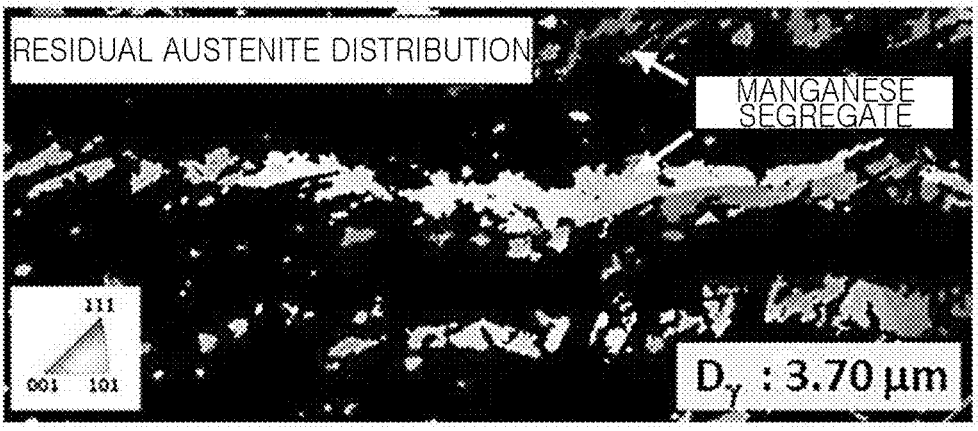

FIG. 2 is a photographic image of Inventive Example 3 observed by electron back-scatter diffraction (EBSD), where (a) is a phase map of austenite (FCC), martensite (BCC) and epsilon martensite (HCP), and (b) is an inverse pole figure map on the austenite (FCC) phase of (a). As illustrated in FIG. 2, it can be understood that in the case of Inventive Example 3 satisfying the conditions of the present disclosure, the retained austenite is distributed along the manganese segregated region in the form of a band, and this microstructure distribution form can be expected to induce effective transformation induced plasticity during tensile deformation.

Figure 3:
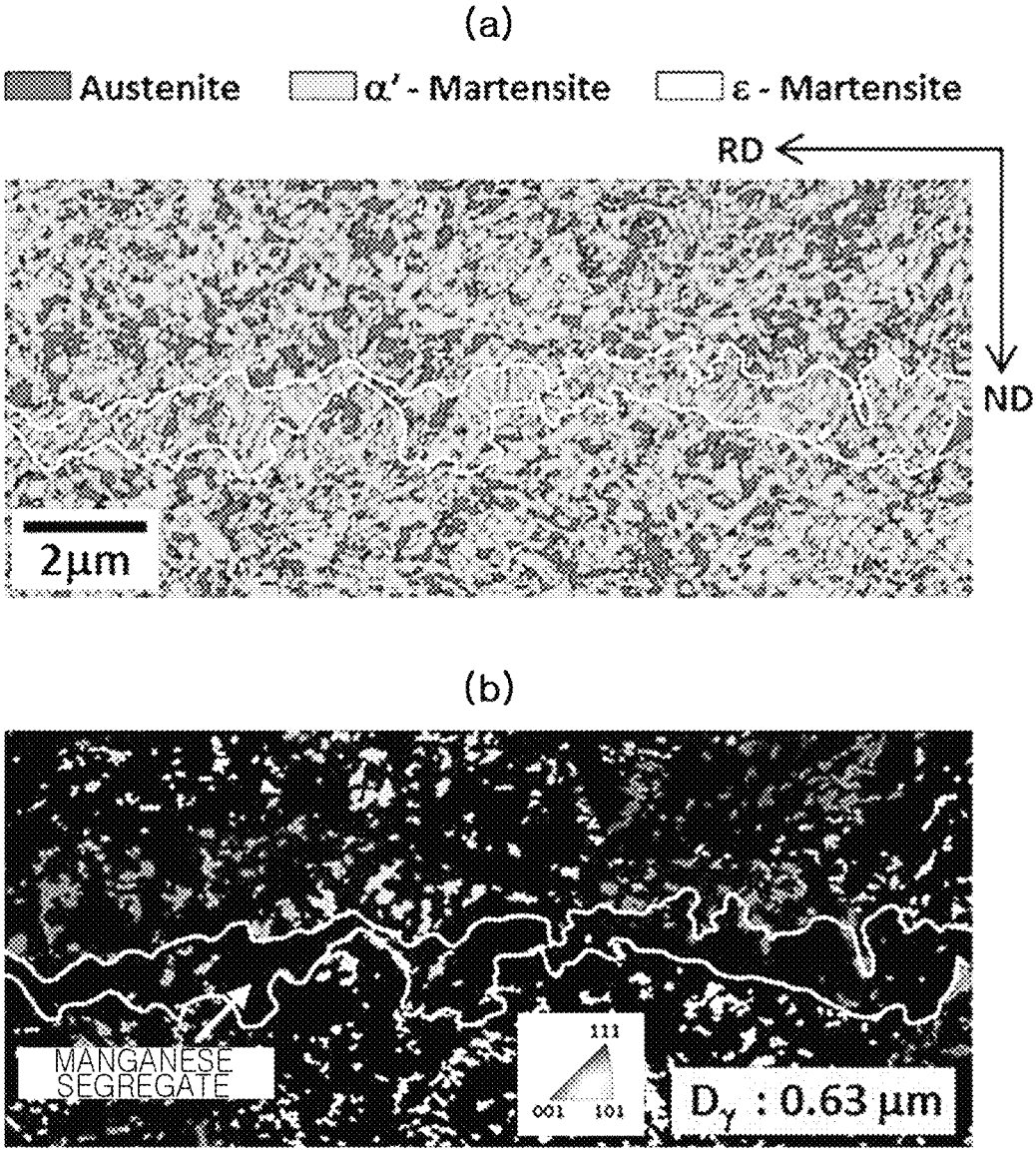
FIG. 3 is a photographic image of Comparative Example 3 observed by EBSD, where (a) is a phase map of austenite (FCC), martensite (BCC) and epsilon martensite (HCP), and (b) is an inverse pole figure map on the austenite (FCC) phase of (a).

FIG. 3 is a photographic image of Comparative Example 3 observed by EBSD, where (a) is a phase map of austenite (FCC), martensite (BCC) and epsilon martensite (HCP), and (b) is an inverse pole figure map on the austenite (FCC) phase of (a). As illustrated in FIG. 3, it can be understood that austenite particles are produced in the Mn-deficient layer.

The invention claimed is:

1. A hot rolled steel sheet having excellent strength and elongation, the hot rolled steel sheet comprising, by wt %:

carbon (C): 0.05% or more and less than 0.4%, manganese (Mn): 10% to 15%, aluminum (Al): 2% or less (excluding 0%), silicon (Si): 0.1 to 2%, molybdenum (Mo): 0.5% or less (excluding 0%), vanadium (V): 0.5% or less (excluding 0%), phosphorus (P): 0.01% or less (excluding 0%), sulfur (S): 0.01% or less (excluding 0%), and a remainder of iron (Fe) and inevitable impurities, wherein the hot rolled steel sheet has a microstructure comprising, by area %, tempered martensite: 50% to 70%, secondary martensite: 20% or less (excluding 0%), epsilon martensite: 2% or less (excluding 0%), and retained austenite: 8% to 30%.

2. The hot rolled steel sheet of claim 1, wherein an average thickness of a manganese segregated region is 1.9 μm to 9.1 μm.

3. The hot rolled steel sheet of claim 1, wherein an average distance between manganese segregated regions is 2.2 μm to 30 μm.

4. The hot rolled steel sheet of claim 1, wherein the hot rolled steel sheet has a tensile strength of at least 1500 MPa, a yield strength of at least 900 MPa and elongation of at least 20%.

* * * * *